United States Patent [19]

Prak

[11] 4,059,955

[45] Nov. 29, 1977

[54] ONE BUTTON DIGITAL WATCH AND METHOD OF SETTING THE DISPLAY

[75] Inventor: Jan Willem L. Prak, Sunnyvale, Calif.

[73] Assignee: Intersil, Inc., Cupertino, Calif.

[21] Appl. No.: 631,120

[22] Filed: Nov. 12, 1975

[51] Int. Cl.[2] ..... G04B 19/30; G04C 3/00

[52] U.S. Cl. ..... 58/23 R; 58/39.5; 58/50 R; 58/58; 58/85.5

[58] Field of Search ..... 58/23 R, 50 R, 85.5, 58/58, 39.5

[56] References Cited

U.S. PATENT DOCUMENTS

| | | | |
|---|---|---|---|
| 3,852,951 | 12/1974 | Sauthier | 58/23 R |
| 3,871,168 | 3/1975 | Maire et al. | 58/23 R |
| 3,889,459 | 6/1975 | Lu | 58/50 R X |
| 3,901,022 | 8/1975 | Cleusix et al. | 58/85.5 |
| 3,934,401 | 1/1976 | Wood | 58/23 R |
| 3,950,935 | 4/1976 | Naito | 58/50 R X |
| 3,952,176 | 4/1976 | Holder et al. | 58/23 R X |

*Primary Examiner*—Stanley J. Witkowski
*Attorney, Agent, or Firm*—Alvin E. Hendricson

[57] ABSTRACT

A system for digitally displaying watch functions and setting the value of these functions with a single actuator button wherein the button is movable to establish a first mode of operation to sequentially display the watch functions and is alternatively movable to establish a second mode of operation wherein the button may be employed to set or adjust the digital readout.

8 Claims, 6 Drawing Figures

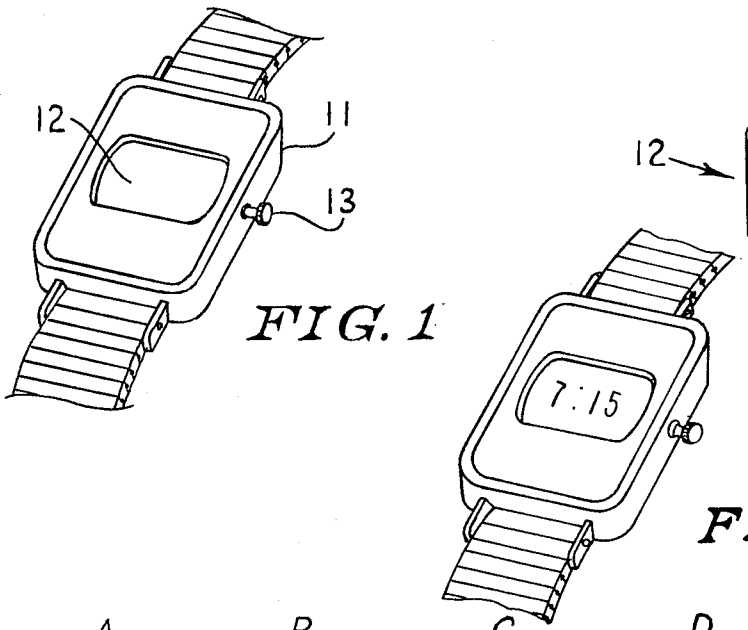
FIG. 1
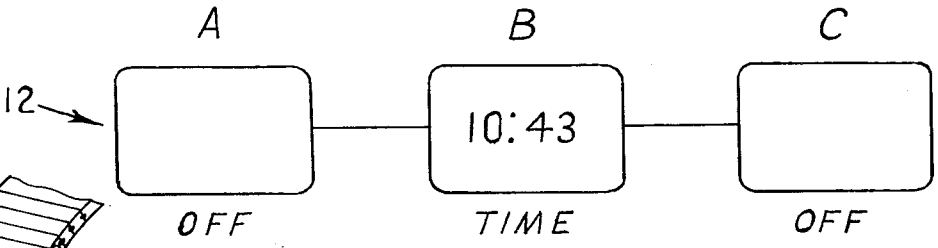
FIG. 2
FIG. 1A
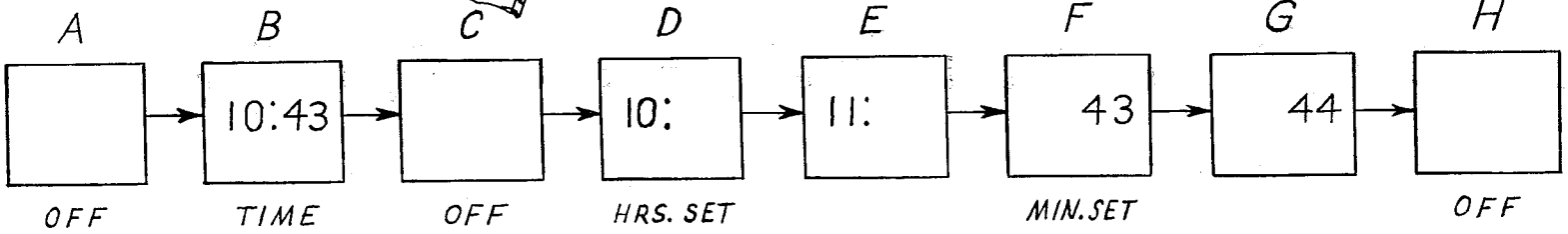
FIG. 3

| Q1 | Q2 | Q3 | DISPLAY STATE |
|---|---|---|---|
| 0 | 1 | 0 | OFF |
| 1 | 1 | 0 | TIME |
| 0 | 0 | 1 | SET HRS. |
| 0 | 0 | 0 | SET MIN. |

ONE BUTTON DIGITAL WATCH AND METHOD OF SETTING THE DISPLAY

BACKGROUND OF INVENTION

Electronic wrist watches having a digital display may employ active or passive display means. Watches having active display means such as light emitting diodes normally display watch functions only upon command in order to conserve the power required for display. Such commands are conventionally provided by a push button extending through the watch case. Watches having passive display means such as liquid crystals continuously display watch functions and may be provided with a push button for changing the functions displayed.

Early digital watches employed what may be termed a logic state switching system for adjusting or setting the watch. Thus, for a watch adapted to display hours, minutes and seconds, activation of a first switch set the hours, activation of the first switch and second switch together set the minutes and activation of the second switch alone maintained the display at zero seconds for time synchronization. This system has been quite satisfactory; however, any attempt to increase the watch functions to be displayed causes a number of difficulties. It is possible to employ a three button system to set up seven functions in a logic state switching system; however, the various combinations and permutations of a non-simultaneous activation of these switches cause the setting operation to be quite complicated and error prone.

An alternative method or system for the display and setting of digital watches provides a sequential operation. Thus, for example, a first switch may be employed to put the watch into various setting modes in sequence while another switch is then employed for adjusting the readout in the set mode.

The present invention provides a system and method of digitally displaying watch functions and setting or adjusting such display with only a single actuator or switch. The present invention materially simplifies adjusting operations by the user of a digital watch and simplifies construction of such a watch with a consequent reduction in size, which is especially important for ladies watches. The invention furthermore reduces the cost of electronic watches.

SUMMARY OF INVENTION

The present invention is adapted for use with a wide variety of different types and kinds of electronic timepieces and wrist instruments including time functions having those having active or passive displays and instruments such as chronographs. In the following description of the invention the term electronic watch is employed to denote any of these timepieces; however, the invention is particularly disclosed with respect to an electronic wrist watch having a digital light emitting diode display. The single button system hereof, as employed in a LED display, provides for button depression in a first predetermined manner to actuate the display and button depression in a second predetermined manner to establish a set mode for successive watch functions whereby successive button depressions advances the value of the displayed watch function to adjust or set same.

In the illustrated examples, the system of the present invention operates with digital display means for an electronic watch wherein such display means are only illuminated or energized upon command. A single button extending from a watch case may be pressed to thus operate a switch in the watch circuitry for applying signals to logic circuitry incorporated in the watch. The single button has a normally extended position and may be manually depressed so as to return to normal extended position immediately upon release of pressure applied to the button. The button may be operated in a variety of different ways to apply a different succession of or different kinds of signals to the logic circuitry within the watch. Thus, for example, the first manner of button operation may be merely the brief depression and release of the button so as to briefly close a switch, for example, to apply a short pulse of electricity from a watch power supply to the watch logic circuitry. The logic circuitry is designed to operate upon receipt of this command to actuate or enable the display means to display the functions generated by the watch such as hours, minutes, seconds and days. An alternative or second manner of button operation or actuation may, for example, comprise depression of the button and holding same depressed for some period of time or possibly the rapid succession of several quick button depressions and releases. This second manner of button operation applies a different signal or set of signals to the logic circuitry or some portion thereof which is employed herein to establish a set mode of watch operation wherein the display means displays at least one watch function and the logic circuitry is connected to watch circuit counters. In this set mode successive button depressions apply signals to watch counters for advancing same as indicated by the display means. This then provides for setting or adjusting the display value of the watch function.

For active display means the present invention may continue the display only for some predetermined period of time after the last button depression. After setting of a first watch function, the set mode is operable to adjust a second watch function upon operation of the button as, for example, in the aforesaid second predetermined manner. The foregoing is repeated for each watch function to be adjusted or set.

It will be seen that, in accordance with the present invention, only a single button is required to actuate the digital display of an electronic watch and also to adjust or choose the functions displayed. It will be appreciated that the logic circuitry employed in the present invention may be varied by the designer while maintaining the requisite functions thereof.

DESCRIPTION OF FIGURES

The present invention is illustrated as to an LED watch display in the accompanying drawings wherein:

FIG. 1 is a perspective view of an electronic wrist watch having a digital display face and a single operating push button in accordance with the present invention;

FIG. 1A is a perspective view of an electronic wrist watch having a passive display in accordance with the present invention;

FIG. 2 is a schematic illustration of steps of digitally displaying the time kept by the watch of FIG. 1;

FIG. 3 is a schematic illustration of steps of the method of the present invention that may be employed in setting the value of a two function watch, for example;

DESCRIPTION OF PREFERRED EMBODIMENT

Figures 4, 5:
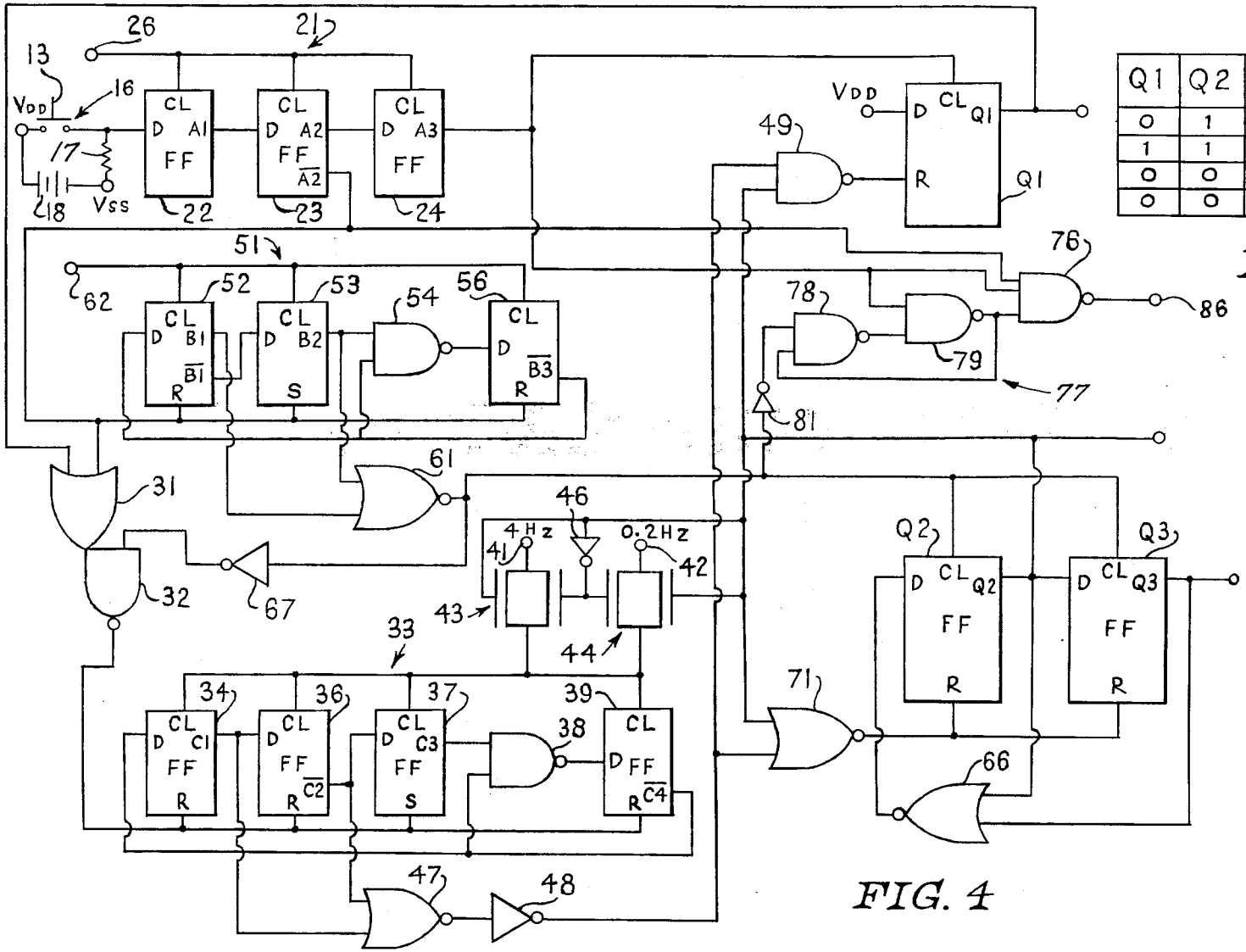
FIG. 4 is a circuit diagram of logic circuitry which may be employed in the system of the present invention.
FIG. 5 is a truth table of the circuit of FIG. 4.

The system and method of the present invention is applicable to any conventional electronic watch having a digital display. In FIG. 1 there is illustrated a watch case 11, having display means 12 on a front face of the watch and a single button 13 extending through the watch case for operation of the display means 12 and setting of the watch functions. This case 11 may also enclose a digital chronograph for timing events or the like. The button 13 normally extends a short distance from the watch case and is adapted to be depressed by the thumb or finger of a wearer of the watch. Conventional digital watches provide a number of actuating buttons and, in an active display, one of these buttons is depressible to actuate the display. Digital watches may generate a plurality of functions such as hours, minutes, seconds, date, and the like, and the number and complexity of the use of actuating buttons normally increases with increased number of watch functions to be displayed and adjusted or set.

The present invention provides but a single actuating button 13 for the watch and watch functions for an active display which are displayed in the manner schematically illustrated in FIG. 2. The digital display face 12 is normally blank, i.e., the watch does not display or read out the value of the functions thereof and thus the display is normally in the OFF condition, as indicated at FIG. 2A. In order to display the time, the wearer or operator merely depresses the button 13 and releases it. This causes the watch functions, i.e., hours and minutes, for example, to be displayed as indicated in FIG. 2B. This illuminated display will remain for a predetermined period of time, and the display will then automatically return to an OFF condition, as indicated at FIG. 2C. Each time the display is to be actuated, the button 13 is depressed, and this manner of display is quite conventional for commerically available LED digital watches.

It is provided by the present invention that the setting or adjusting of the watch shall be materially simplified over conventional digital watches, in that only the single button 13 is employed, both for actuating the display and for setting the watch. The sequence of operations is illustrated in FIG. 3 for setting a two-function digital watch. However, it is to be appreciated that the invention is equally applicable to 3, 4 or 5 function watches.

Referring now to FIG. 3, it is noted that the display 12 is first in the OFF condition, as indicated at FIG. 3A. In order to proceed with setting the watch, the single button 13 is operated in a different manner from that employed to actuate the display for READOUT. As noted above, digital READOUT is initiated in this example by a short depression of the button 13, with a substantially immediate release of the button. As an example of the method of the present invention, setting of the watch may be accomplished by a depression of the button 13 for a longer period of time such as three or more seconds. In one system in accordance with the present invention, this long depression will cause the time to be displayed, as indicated at FIG. 3B, and after normal display time, the display will return to OFF condition, as indicated at FIG. 3C. The long depression has, however, established a condition within the logic circuitry of the watch, so that after a short period of no display the watch will then display the hours only, as indicated at FIG. 3D. The foregoing places the watch in the SET mode, and the hours may then be set by successive short depression of the buttom 13, each depression advancing the display number by 1. This is indicated at FIG. 3E, wherein a single short depression has advanced the reading from 10 to 11. The hours set condition will remain for some predetermined period of time, such as 20 to 25 seconds, and if no further depressions or button actuations are made, the display will revert to the normal OFF condition of FIG. 2A. This feature may be incorporated in order to prevent inadvertent power drain of the watch battery by failure of an operator to turn off the display.

In order to proceed with the setting of the minutes of the display, as schematically illustrated in FIG. 3 and following setting of the hours display, the operator again depresses the button 13 of the watch for an extended period, such as 3 or more seconds during the predetermined period of 20 to 25 seconds. This will cause the minutes display to appear on the face, and in at least one system in accordance with the present invention will also remove the hours display. Consequently, there will be displayed upon the face only the minutes, as indicated at FIG. 3F. The display is then changed one number for each short depression of the button 13, and in FIG. 3G there is illustrated the display after one button depression. Assuming that the proper time at the end of this operation is 11:44, as indicated in the example of FIG. 3, the operator then merely waits until the expiration of the TURN OFF period which is noted above to be about 20 to 25 seconds, and the display will revert to an OFF condition, as shown at FIG. 3H, which is the same as that of FIG. 2A. The watch does, however, continue to internally "keep time" so that the next short button depression causes a display of the proper hours and minutes.

It will be appreciated from the foregoing description of an example of the method hereof that the setting of a digital watch is materially simplified by the present invention. The operator or user of the watch need not manipulate a plurality of buttons, nor operate a plurality of buttons in particular combinations to achieve the desired setting of the watch. It is only necessary, in accordance with the present invention, to place the watch in a SET mode by one particular type of button actuation, and then to advance the display to the desired display numbers corresponding to the exact time as determined from some other time source. It is to be further noted that numerous variations of the method hereof are possible. Thus, a single long depression of the watch button to establish the SET mode of the watch is only given herein as an example. A number of rapid depressions might instead be employed as the appropriate signal to logic circuitry in the watch for establishing the SET mode. It will also be appreciated that the method of the present invention may be carried out by logic circuitry of varying configurations. Once the functions to be performed are properly delineated, it is within the skill of the art to electronically accomplish these functions. Particularly in the field of digital watches, it is conventional for electronic circuitry employed therein to be formed as integrated circuits, at least in part. This serves to minimize the space requirements and, actually, to maximize the reliability of the end product. It will also be appreciated that there is a latitude in the exact nature of functions to be performed and order of performance, so that a designer carrying out the present invention has a certain degree of latitude in the electrical and physical layout. There is illustrated in FIG. 4 one example of logic circuitry suitable for carrying out the method of the present invention in one preferred manner.

Referring now to FIG. 4 of the drawings, there will be seen to be illustrated a normally open spring-loaded single pole, single throw switch 16 operated by the watch button 13 and connected in series with a resistor 17 across a power supply illustrated as a battery 18. At the positive side of the battery, there is shown a terminal identified as $V_{dd}$ which is the most positive voltage (logic one) of the system and at the negative side of the battery there is identified a terminal $V_{ss}$ which is the most negative voltage of the system (logic zero). The logic diagram of FIG. 4 provides a system in accordance with the present invention for operating a two-function LED wrist watch, and it is noted that positive logic is employed throughout, and furthermore, that the flip-flop circuits trigger on the positive clock edge. The switch 16 connects $V_{dd}$ to a 3-stage shift register 21, including first, second and third flip-flop circuits 22, 23 and 24, respectively. These flip-flop circuits are clocked at a 64 Hertz clock rate applied from a terminal 26 to the clock terminals of the flip-flops. This shift register is employed to protect against switch bounce.

Figure 6:
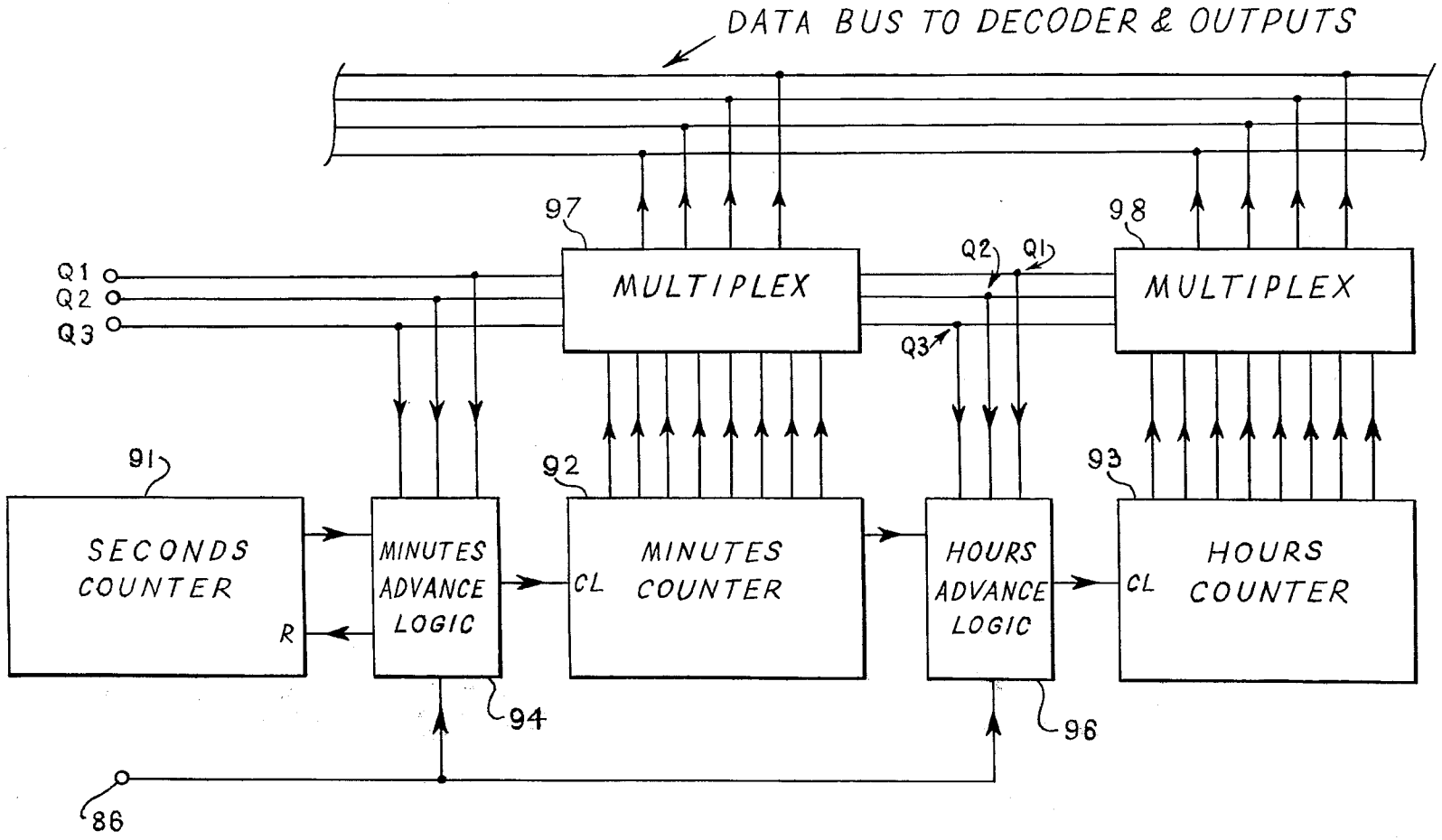
FIG. 6 is a block diagram of additional circuitry that may be employed with the circuitry of the present invention.

There is provided in the circuit of FIG. 4 a multistate circuit including three master flip-flop circuits Q1, Q2 and Q3, and in FIG. 5 there is illustrated a truth table for the watch states corresponding to the valid combinations of outputs of Q1, Q2 and Q3. The output of Q1, Q2 and Q3 are connected to further conventional watch circuitry as generally shown in FIG. 6. An output A3 of the shift register 21 is applied to the clock terminal of flip-flop Q1, with $V_{dd}$ applied to the D terminal thereof, so that when the shift register output goes to logic 1, flip-flop Q1 is toggled or switched to a 1 output.

Assuming first that the circuit is in the "display off" state wherein the outputs Q1 = 0, Q2 = 1, and Q3 = 0, as set forth in the truth table of FIG. 5, it will be seen from the foregoing that activation of the switch 16 to cause Q1 = 1 will then place the circuit in the time display mode wherein Q1 = 1, Q2 = 1, and Q3 = 0. Immediately prior to switching the flip-flop Q1 to a 1 output, the output $\overline{A2}$ of the shift register 21 becomes 1 and this will be seen to be applied through an OR circuit 31 to a complex gate 32, thereby producing a positive pulse at the output of this gate. This positive output of gate 32 is connected to reset a timing circuit 33 consisting of a shift register including flip-flops 34, 36, 37, gate 38, and flip-flop 39. The timer 33 is operated at either a 4 Hz or a 0.2 Hz rate and signals of these frequencies are shown to be applied to terminals 41 and 42. With the output Q2 = 1, the timer operates at a 4 Hz rate inasmuch as the terminal 41 is connected to the clock terminals of the flip-flops of the timing circuit 33 through a field effect transistor 43 which is placed in a conducting state by virtue of the application of a positive signal to the N side thereof and a negative signal to the P side thereof through the inverter 46. With the output Q2 = 0 a field effect transistor 44 connects the terminal 42 to the clock inputs of the timing circuit 33 while the field effect transistor 43 is turned off. The sequence of timer states of timer 33 is as follows:

0010 reset
1010
1110
1100
1101
0101
0001
0011 stable The timer 33 remains in the stable state 0011 (which identifies the outputs of the successive flip-flops 34, 36, 37 and 39) until reset by a positive input pulse from the gate 32. This pulse then causes the timer to start running and when the timer reaches the 0101 state a gate 47 decodes this state to produce a positive gate output. It will be seen that the gate 47 is connected to C1 of 34 and $\overline{C2}$ of 36 so that in the 0101 state of the timer both inputs of the gate 47 are positive. This production of a positive signal at the output of the gate 47 occurs 5 clock pulse edges after the timer is reset, which is then equal to an interval of 1.0 to 1.25 seconds at a 4 Hz rate and 20 to 25 seconds at a 0.2 Hz rate. When Q1 = 1 (and the watch displays hours and minutes) signals produced by additional actuations of the switch 16 are inhibited by the gate 32 so that the interval during which the time display is "on" does not depend on further actuations of the switch 16. The positive pulse produced by the gate 47 is inverted by an inverter 48 and and applied to an OR gate 49 having the other input thereof connected to Q2. Consequently, the positive output signal from gate 47 produces an output signal from OR gate 49 which is applied to the reset of flip-flop Q1 so that the output thereof then becomes Q1 = 0 to turn off the display after 1 - 1.25 seconds.

There is provided as an additional portion of the logic circuits of FIG. 4 a second timer circuit 51 consisting of shift registers or flip-flop circuits 52, 53, gate 54, and flip-flop 56. This timer 51 is normally in the reset state 010 and, in order to produce an output from the time 51, the switch 16 must be closed until the timer output occurs, inasmuch as earlier release of the switch 16 will apply a positive reset pulse to the timer from flip-flop 23 of the shift register 21 and cause the timer 51 to start over again. If the switch 16 is held closed long enough, the sequence of states of timer 51 is as follows:

010 reset
110
100
101
001
011 stable

A gate circuit 61 has the inputs thereof connected to B1 and B2 of flip-flops 52 and 53, respectively, for decoding the 001 state of timer 51 which occurs 4 clock edges after removal of reset. Consequently closure of the switch 16 for a period of 4 seconds or more produces an output from 61 which clocks flip-flop circuits Q2 and Q3. The flip-flops Q2, Q3, and gate 66, having the inputs thereof connected to the outputs Q2 and Q3 and the output of the gate connected to the input D of Q2, form a three-state counter having the states 10, 01 and 00. The output signal from gate 61 is also applied through an inverter 67 to gate 32 to actuate the timer circuit 33. It will be appreciated that the timer 33 operates at the 0.2 Hz rate inasmuch as flip-flop Q2 has been clocked by the signal from gate 61 to produce a Q2 = 0 output. Consequently, about 20 to 25 seconds later the gate circuit 47 will produce an output signal which will reset flip-flop Q1 and return the display to an "off" condition.

Considering further the operation of the circuit of FIG. 4, it is again noted that, with the switch 16 held "on" or in a closed condition for 4 seconds or more, the time display will first come on as previously described and will then go off after 1 to 1.25 seconds. After the switch 16 is closed for 3 or 4 seconds, the circuit will enter the hours set mode wherein Q1, Q2 and A3 are in the 001 state. Inasmuch as the output Q2 is applied as one input to the gate 49, the flip-flop Q1 is held in a 0 output state whenever either the hours or minutes set mode is active. Upon release of the switch 16 the timer 33 will cause the circuit to return to the display off mode after 20 to 25 seconds because the signal at the output of gate 47 is inverted and applied to the gate 48 and is also applied through a gate 71 to reset Q2 and Q3. This then prevents the watch display from accidentally being left on and depleting the battery. If, however, the switch 16 is operated during the foregoing 20 to 25 seconds, the signal applied to gate 32 will cause the timer 33 to be reset every time the switch is activated and this will in turn prevent application of a signal through gates 48 and 71 to return the display to an off condition.

The watch display is advanced at each of the set modes by closing the switch 16 for less than 3 seconds. An output gate 76 applies pulses to the hours and minutes counters to advance these counters through appropriate circuitry as indicated in FIG. 6, and a latching circuit 77 is connected to one input of the gate 76. One input of the latching circuit 77, comprising gates 78 and 79, is obtained from the output of the shift register 21 and the other input is obtained through an inverter 81 from the gate 61 decoding the output of counter 51. A third input of the output gate 76 is obtained from A2 of shift register 21. With this circuitry each closure of the switch 16 in a set mode of the circuit will cause a pulse on the output of gate 76 and this pulse is gated into either the hours or minutes counter of the watch. The latch 77 is normally in the 1 state on the output of gate 79 so that a pulse occurs at the output of the gate 76 when switch 16 is opened and A2 returns to 1 before A3 returns to 0. Should the switch 16 be held down or closed for a long period of time when the watch is in one of the set modes, an output pulse will occur at the gate 61 which will then be inverted in the inverter 81 and applied to the gate 78 causing the output of gate 79 to change to 0 and then inhibit gate 76 so that no pulse from the circuit will be applied to the counters. Consequently only short activations of the switch 16 in either set mode of the circuit will cause pulses to be applied to the gate 76 to advance the counters. This long actuation or closure of switch 16 in the hours set mode of the watch not only prevents the signals being applied to the counters but furthermore applies a second clock pulse to the flip-flops Q2 and Q3 to then reverse the conditions thereof and place the watch in the minutes set mode wherein Q1, Q2 and Q3 are in the state 000, as indicated in FIG. 5. In this state short depressions of the switch 16 will also produce output pulses at gate 76 which are appropriately gated to the minutes counter for advancing the setting thereof at the command of the operator.

The signals at Q1, Q2, Q3 and an output terminal 86 of gate 76 may be employed in relatively conventional manner to control the watch circuit. In FIG. 6 there is shown seconds counter 91, minutes counter 92 and hours counter 93 with a minutes advance logic circuit 94 connected to the seconds and minutes counters and an hours advance logic circuit 96 connected to the minutes and hours counters. Logic output terminal 86 is connected to both advance logic circuits 94 and 96 and Q1, Q2 and Q3 are also connected to these circuits 94 and 96. The minutes and hours counters 92 and 93 are connected through multiplex circuits 97 and 98, respectively, to a data bus 99 that, in turn, is connected to a decoder and outputs (not shown) and Q1, Q2 and Q3 are connected to control the multiplex circuits 96 and 97 in accordance with the states as shown in FIG. 5.

The operation of the circuitry of FIG. 6 is straightforward in that a logic circuit output pulse at terminal 86 with Q1, Q2, Q3 in the 0,0,0 state, for example, which cause the minutes counter 92 to be advanced by one count and may, for example, reset and hold the seconds counter 91. In this manner of operation a subsequent time display operation of the watch at Q1 = 1, Q2 = 1 and Q3 = 0 at zero seconds in real time will restart the seconds counter from zero so that both minutes and seconds have been adjusted to the correct time. The application of count signals to the data bus 99 is controlled by the multiplex circuits.

It is noted that the logic circuit of FIG. 4 employs conventional electronic and logic circuit conventions and notations and consequently the description of this figure is limited to the foregoing resume of operation. It is believed apparent that the logic circuitry may be varied in many ways and may even be alternatively comprised as long as it does carry out the method of the present invention. In particular, it is noted that the circuitry of FIG. 4 is directed to the described embodiment of the present invention wherein a long or extended depression to button 13 serves to cause the watch circuitry to enter a set mode as distinguished from short depressions of the button employed to display the time or to advance the hours or minutes displayed in the set mode. Clearly, the utilization of a different coding system wherein, for example, 3 short successive depressions of the button 13 cause the circuit to enter a set mode will require alternative logic circuitry. The design of such alternative logic circuitry is within the skill of those knowledgeable in the art following an understanding of the basic concepts of the present invention.

The present invention has been described above in relation to a particular manner of switch actuation or button depression. However, as previously stated, numerous variations are possible in this respect. Thus, for example, an LED digital watch display may be operated in accordance with the present invention by providing for one short button depression to actuate the display of hours, minutes and date. Such display may then persist for a predetermined short period of time to allow reading of the display and then go off. Two short depressions of the watch button may be employed to cause a display of seconds with the display changing each second for some predetermined period of time, such as perhaps twenty seconds or the like, in order that the user may time some occurrence taking a number of seconds to complete. At determination of the seconds display, the display returns to an off condition. Three short depressions of the watch button may be employed to establish a set mode wherein a successive function of hours, minutes, day and month, for example, are sequentially displayed for a predetermined period of time, such as twenty seconds, and during such period each short depression of the button would advance the function displayed. The various functions may be sequentially displayed throughout the order thereof for setting of separate functions in the manner described. The foregoing is also only one example of one button watch operation in accordance with the present invention.

For a passive display employing, for example, liquid crystals, the present invention may provide for the time, i.e., hours and minutes, to be normally continuously displayed and a single short button depression to change the display to day and date for some predetermined period and then revert back to hours and minutes display. Two short depressions of the button may cause the seconds to be displayed for some predetermined period of time during which the display changes each second. Three short depressions of the button may place the watch in a set mode, wherein the successive functions are displayed for some predetermined period of time in sequence and may each be advanced by a short button depression during the set period for each function and at the end of which the display returns to the hours and minutes display.

In FIG. 1A there is illustrated, as a further example of the present invention, an LCD wrist watch which may be comprised as an integrated circuit having an oscillator divider, voltage multiplier, decoder and output buffers on a single chip, with which there is employed the display, crystal, trimming capacitor, two voltage doubler capacitors, a 1.55V battery and a single switch. Such a watch may display five functions, i.e., hours and minutes, month and date, and seconds. One button operation in accordance with the present invention provides a short button depression for month/date or seconds, a long depression to cycle through set modes and a short depression to advance in set modes. Such a system may be arranged to operate in one of six basic modes, as follows:

RUN I
RUN II
SET MONTH
SET DATE
SET HOURS
SET MINUTES

The foregoing modes are addressed by the one button system of the present invention. When the button is pushed in or depressed and held for 3–4 seconds, the circuit will advance to the next mode and stay there until the button is released and pushed or depressed and held in again. Any activation of the button for less than three seconds is considered a "short" push and is employed to address the circuit in the RUN I or RUN II modes or to advance the counters in the SET modes. In the RUN I mode illustrated in FIG. 1A the circuit normally displays hours and minutes with a flashing colon therebetween. One short depression or push of the switch brings up or displays the month and date with no colon therebetween, and such display lasts for approximately two seconds and then the display returns to hours and minutes. A short push or button depression in the month/date display or two short button actuations in the time display places the circuit in the seconds display condition. In this condition the colon is on and the unit minutes are displayed in the unit hours position. The rolling or changing seconds distinguishes the seconds display from the time display. One more short button depression returns the circuit to the time display. In the Run II mode the circuit alternates between time and month/date, with each being displayed for two seconds. The colon is on in the time display and is off in the month/date display. A single short button depression causes seconds to be displayed and a second short button depression restores the alternating display of time and month/date.

The watch is placed in a setting mode by a single long depression of the button for more than three to four seconds. In the month SET mode the display is advanced 1 count or number for each short button depression. A further long button depression changes the display to the date set mode, wherein the data displayed is advanced one count per short button depression. A further long button depression in the date set mode will place the display in the hours set mode, wherein the hours count is advanced by one for each short button depression. A further long button depression in the hours set mode will establish the minutes set mode, wherein the displayed minutes number is advanced one count per short button depression. Upon advancing the minutes count, the seconds counter is reset and held at zero. The reset of the seconds counter is removed by advancing to the RUN I mode and depressing the switch for a short time at zero seconds of real time. Consequently, the setting accuracy is one second. Obviously, many variations may be made in the foregoing system by the designer of any particular watch circuit, and yet all in accordance with the present invention.

It is furthermore noted that the present invention is equally applicable to utilization with instruments having functions to be displayed in addition to time. Consequently, the term "electronic watch" as herein employed is intended to encompass not only conventional timepieces but devices such as a wrist instrument that may display time and other functions. The invention is also particularly applicable to chronographs, wherein, for example, a short button depression might be employed for starting and stoping of time displayed, and a long button depression may be employed to reset the display.

The foregoing decription of the present invention is intended only as an illustration or particular preferred embodiments of the present invention and is not intended to be limiting upon the invention. It will be apparent to those skilled in the art that numerous modifications and variations are possible within the scope of the present invention, and thus it is not intended to limit the invention to the details of illustration nor terms of description.

What is claimed is:

1. A single button digital watch display system for an electronic watch that generates a plurality of time varying functions for display as digits by display means on a watch face comprising:

a single button on said watch being manually movable between a normal extended position and a depressed position, a normally open switch in said watch operable to close in the depressed position of said button, a power supply in said watch, logic circuitry in said watch and connected by said switch to said power supply whereby switch closure applies an input signal to the logic circuitry, said logic circuitry being responsive to input signals of different total duration in a predetermined time period to establish different display modes of said display means and a set mode of operation of said display means, and said logic circuitry in said set mode being responsive to successive switch closures to apply successive set signals to said display means for adding digits to the display.

2. The system of claim 1 further defined by said logic circuitry including means turning off said display means in said set mode after a predetermined time following the last switch actuation.

3. The system of claim 1 further defined by a source of clock pulses of different predetermined repetition rates, said logic circuitry including a multistate circuit responsive to said input signals of different total duration to establish different states thereof, and said logic circuitry also including timing means operable at different clock rates as established by the state of said multistate circuit to apply set signals to said display means for setting the display of separate watch functions.

4. The system of claim 3 further defined by switching means connecting said source of clock pulses to said timing means and connected to said multistate circuit for control thereby to apply clock pulses of different rates to said timing means in accordance with the state of said multistate circuit.

5. A method of digitally displaying a plurality of time functions of an electronic watch and setting such displayed time functions comprising the steps of:

applying electronic signals representative of a first plurality of watch functions to digital display means each time that a switch is actuated in a first manner in which said switch is actuated for a first predetermined total duration in a predetermined time and continuing such display energization only for a predetermined first period of time, applying electronic signals representative of a single first watch function to digital display means upon actuation of said same switch in a second manner in which said switch is actuated for a second predetermined total duration in a predetermined time to establish a set mode of display, applying further electronic signals to said digital display means in said set mode of display to advance the displayed digits by a short actuation of said same switch for each signal to be applied to said display means.

6. An improvement in a chronograph having a digital display of instrument functions and a single actuator button and power supply means comprising logic circuitry connected to said power supply means by a single-pole single-throw switch operated by said actuator button and responsive to a single short operation of said actuator button to establish a first mode of operation wherein the display of time is initiated and terminated by said single short operation of said actuator button and responsive to operation of said actuator button for a longer duration in a predetermined time period to establish a different mode of operation being reset to zero and hold of the display whereby said actuator button and switch perform the functions of two actuator buttons and switches.

7. An improvement in a watch instrument having a LED digital display of instrument functions and a single actuator button and power supply means comprising logic circuitry connected to said power supply means by a single-pole single-throw switch operated by said actuator button and responsive to a single short operation by said actuator button to establish a first mode of instrument operation and responsive to operation of said actuator button for a longer duration in a predetermined time period to establish a second mode of instrument operation, said first mode of operation being actuation of time display and said second mode of operation being establishment of a set mode of operation wherein time is displayed and advanced by single short operations of said actuator button whereby said single actuator button and switch perform the functions of two actuator buttons and switches.

8. An improvement in a watch instrument having a LCD digital display of instrument functions and a single actuator button and power supply means comprising logic circuitry connected to said power supply means by a single-pole single-throw switch operated by said actuator button and responsive to a single short operation of said actuator button to establish a first mode of instrument operation and responsive to operation of said actuator button for a longer duration in a predetermined time period to establish a second mode of instrument operation, said first mode of operation being a display of day and month for a predetermined period of time rather than the normal display of time and said second mode of operation being a set mode of operation wherein time is displayed and advanced by each single short operation of said actuator button whereby said single actuator button and switch perform the functions of two actuator buttons and switches.

* * * * *